US006329619B1

(12) United States Patent
Koguchi

(10) Patent No.: US 6,329,619 B1
(45) Date of Patent: Dec. 11, 2001

(54) PRESSURE SWITCH

(75) Inventor: Masayuki Koguchi, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/482,643

(22) Filed: Jan. 13, 2000

(30) Foreign Application Priority Data

Feb. 17, 1999 (JP) ..... 11-038185

(51) Int. Cl.[7] ..... H01H 35/40
(52) U.S. Cl. ..... 200/83 J; 200/83 P
(58) Field of Search ..... 200/406, 517, 200/83 P

(56) References Cited

U.S. PATENT DOCUMENTS 4,194,105 * 3/1980 Hodges ..... 200/159 B
4,214,137 * 7/1980 Hartley ..... 200/83 P
4,349,712 * 9/1982 Michalski ..... 200/159 B
4,794,214 * 12/1988 Sanford ..... 200/83 P
4,820,890 * 4/1989 Tamura et al. ..... 200/81.4
4,827,094 * 5/1989 Tanaka et al. ..... 200/83 J
4,845,322 * 7/1989 Iwakiri et al. ..... 200/81 R
4,853,504 * 8/1989 Tanaka et al. ..... 200/83 P
4,939,321 * 7/1990 Tanaka et al. ..... 200/83 P
5,149,927 * 9/1992 Stahly ..... 200/83 P
5,508,483 * 4/1996 Czarn et al. ..... 200/83 J
5,872,345 * 2/1999 Takahashi et al. ..... 200/83 J
5,889,247 * 3/1999 Homol ..... 200/83 P
5,917,164 * 6/1999 Sasaki ..... 200/83 P
5,932,857 * 8/1999 Stander et al. ..... 200/83 B

* cited by examiner

*Primary Examiner*—Renee Luebke
*Assistant Examiner*—Nhung Nguyen
(74) *Attorney, Agent, or Firm*—Armstrong, Westerman, Hattori, McLeland & Naughton, LLP

(57) ABSTRACT

A pressure switch comprises a switch lever 8 equipped with a switch contact and a working shaft contact portion 82, and a working shaft 6 driven by the pressure of a fluid so as to close or open said switch contact, wherein said contact portion 82 has a spherical surface with a radius of curvature in the range of 2.0 mm to 0.5 mm.

3 Claims, 4 Drawing Sheets

PRESSURE SWITCH

FIELD OF THE INVENTION

The present invention relates to a structure of a pressure switch mainly used in a refrigeration cycle of a cooling device mounted on a vehicle, which is set to stop a compressor and protect the system when a refrigerant pressure in the refrigeration cycle becomes either more than or equal to a predetermined pressure or less than or equal to a predetermined pressure.

DESCRIPTION OF THE RELATED ART

A conventional pressure switch of this kind is shown in FIGS. 2 and 3.

FIG. 2 is a vertical cross-sectional view showing the structure of a pressure switch. FIG. 3 is an enlarged cross-sectional view showing a portion of FIG. 2 encircled by a broken line A. In both drawings, the pressure switch is shown in an inverted position from the actual position of use.

In the drawing, the pressure switch 100 comprises a housing 1 including an inner space, a switch case 2, a diaphragm 3, a first snap disk 41, a second snap disk 42, a receive member 5, a working shaft 6, a first switch lever 7 and a second switch lever 8.

The housing 1 comprises a passage 11 equipped to one end for introducing fluid, an inner space 12 opening to the other end, a stopper 15 for fixing a seal member 29, and a seal support member 16.

The seal member 29 is formed as an annular elastic body formed for example of nitrile butadiene rubber, and the member is supported by the seal support member 16.

The switch case 2, made of an electric insulating material such as a polybutyl terephthalate resin reinforced by glass fiber, has an opening portion formed to one end thereof which is mechanically press-fixed to the other end of the housing 1 with the seal member 29 placed therebetween.

The switch case 2 comprises an inner space 21 with one end being opened and to which a pressure switch mechanism is placed, and an opening 22 formed on the other end for electrical connection. The inner space 21 and the opening 22 are separated by a partition wall.

A guide wall 24 for guiding a receive member 5 is formed around the inner space 21. On the guide wall 24 in the partition wall-side is formed a limiting step 25 which protrudes inwardly so as to limit the movement of the receive member 5 toward the partition wall.

Moreover, a supporting step 26 with a smaller diameter for supporting the rim portion of a second snap disk 42 is formed inwardly on the partition wall-side of the limiting step 25.

The pressure switch mechanism stored inside the inner space 21 of the switch case 2 comprises a diaphragm 3 made for example of polyimide resin film, a first snap disk 41 made of steel, a receive member 5 made for example of polybuthylene terephthalate (PBT) resin, a second snap disk 42 made of steel, a working shaft 6 made for example of ceramic, a first switch lever 7, a second switch lever 8, and a pair of terminals 9.

The peripheral of the diaphragm 3 in the pressure switch mechanism is mounted to an end 27 of the surrounding wall of the inner space 21 in the switch case 2, which is airtightly fixed through a seal member 29 to the seal support member 16 equipped to the housing 1.

The receive member 5 is disk-shaped, and on the rim portion of the surface of the disk is formed an outer wall 51 protruding upwards. A penetrating hole 52 is formed to penetrate through the front surface and the back surface of the receive member at the center area, and a central protrusion 53 is formed to protrude around the penetrating hole 52 on the back surface.

The receive member 5 is stored in the inner space so that it slides in the central axis direction of the switch case, guided by the guide wall 24 of the switch case 2.

The first snap disk 41 is placed so as to contact the diaphragm 3, being supported by the surface of the receive member 5, and further being positioned by the outer wall 51. The working shaft 6 is stored inside the penetrating hole 52 of the receive member 5 and is contacted to the back surface of the first snap disk 41, and it is further extended toward the second switch lever 8.

To the exterior of the central protrusion 53 of the receive member 5 is assembled a central opening 43 formed to the center of the convex-shaped second snap disk 42. The end of the central protrusion 53 is placed opposite to the center surface of the first switch lever 7.

The working shaft 6 is made for example of ceramic, and the peripheral area of the end surface thereof may be chamfered. The chamfering may either be linear, as is shown in the drawing, or may be arc-like.

The first switch lever 7 is formed of an elastic body having conductivity, such as phosphorus bronze, and one end portion of the lever 7 is fixed to the surrounding wall of the inner space 21. A contact 71 is equipped to the other end of the first switch lever 7, and an opening 72 is formed to the intermediate area of said one end and the other end, through which the working shaft 6 penetrates.

The second switch lever 8 is formed of an elastic body having conductivity, such as phosphorus bronze, and one end portion of the lever 8 is fixed to the surrounding wall of the inner space 21. A contact 81 is equipped to the other end of the second switch lever 8, and a contact portion 82 is formed to the intermediate area between said one end and the other end, to which the end surface of the working shaft 6 touches.

One pair of terminals 9 are connected to the first switch lever 7 and the second switch lever 8 respectively, which penetrate through the partition wall 23 and are taken out from the opening 22.

The first switch lever 7 and the second switch lever 8 constitute the switch mechanism.

As shown in FIG. 3, the contact portion 82 equipped to the second switch lever 8 is formed for example through press-working, and the surface of the contact portion 82 is formed as a flat surface 89.

The operation of the pressure switch of the prior art will now be explained.

The fluid pressure loaded to the diaphragm 3 through the fluid passage 11 pushes the diaphragm 3 downward, and the receive member 5 supporting the first snap disk 41 is pushed down. When this pressure reaches 0.25 MPa for example, the second snap disk 42, which is originally in its first position in which the disk protrudes toward the diaphragm (as shown in the drawing), is shifted to a second position in which the center portion of the disk is displaced toward the partition wall. When the snap disk 42 is displaced, the receive member 5 is pushed by the fluid pressure and moves toward the partition wall, and the central protrusion 53 presses the first switch lever 7, thereby making the switch.

The receive member 5 being moved toward the partition wall will bump against the limiting step 25 formed to the inner wall of the switch case 2, which limits further movement of the receiver member toward the partition wall even when fluid pressure rises. Therefore, the second snap disk 42 will not receive further force, and the disk 42 will be free from any unnecessary deformation which may damage its function.

When pressure is reduced and the fluid pressure lowers to 0.21 MPa, the second snap disk 42 shifts from the second position to the first position (shown in the drawing), the receive member 5 moves toward the passage 11, and the central protrusion 53 will no longer be pressed against the first switch lever 7. Thus, the switch is opened.

When fluid pressure rises to 2.7 MPa during the state the receive member 5 is bumped against the limiting step 25 and the switch is made, the first snap disk 41 shifts from the first position in which the disk is protruded toward the diaphragm (as shown in the drawing) to the second position in which the center portion protrudes toward the partition wall. The displacement is transmitted through the working shaft 6 to the second switch lever 8, which is pushed down, thus opening the switch.

As explained, the prior art pressure switch is operated to make the switch at a predetermined pressure, and to open the switch at two pressure values, one higher than and one lower than the predetermined pressure.

SUMMARY OF THE INVENTION

The prior art pressure switch 100 as explained above has a contact portion 82 formed to the second switch lever 8 with a flat surface 89. When the accuracy of the members forming the pressure switch is poor, or the accuracy of assembling the switch structure is poor, the end surface of the working shaft 6 may not be placed parallel to the surface of the contact portion 82 as shown for example in FIG. 4, which causes an offset of the shaft 6.

FIG. 4 is a drawing showing a typical state of contact of the working shaft and the contact portion formed to the switch lever, in which the continuous line shows the state where the working shaft is not positioned parallel to the surface of the contact portion (offset), and the chain double-dashed line shows the state where the working shaft contacts the surface of the contact portion in a parallel position. As could be seen from FIG. 4, it is clearly preferred that a wide area of the end surface 61 of the working shaft 6 touches the surface 89 of the contact portion 82 formed to the second switch lever 8.

However, when the accuracy of assembly of the switch or the accuracy of the members is poor, the center axis 63 of the working shaft 6 is likely to tilt and not cross the surface 8 of the contact portion 82 perpendicularly, as shown by the continuous line of FIG. 4. In such case, the working shaft 6 will be offset, and only a point 62 on the peripheral of the end surface 61 of the shaft 6 will contact the surface 89 of the contact portion 82.

When offset occurs, only one point 62 on the peripheral of the end surface 61 of the shaft 6 contacts the surface 89 of the contact portion 82, and point 62 will receive collected pressure repeatedly. After a long term of use, a portion of the point 62 may be chipped and lost.

When such problem occurs, not only will the accuracy of the switch operation be damaged, but the function of the contact may be ruined as well.

The present invention is aimed at solving the above problems. The object of the present invention is to provide, without changing the design of the prior art pressure switch greatly, a pressure switch which may be assembled easily without having to unnecessarily improve the accuracy of assembly of the members, and which has a high reliability.

In order to achieve the above object, the present invention discloses in claim 1 a pressure switch comprising a switch lever equipped with a switch contact, and a working shaft driven by fluid pressure to open or close said switch contact, said switch lever including a contact portion to which said working shaft contacts, wherein said contact portion is formed to have a spherical surface.

The present invention discloses in claim 2 a pressure switch according to claim 1, wherein said spherical surface has a radius of curvature in the range of 2.0 to 0.5 mm.

The present invention discloses in claim 3 a pressure switch according to claim 1, wherein said spherical surface has a radius of curvature in the range of 2.0 to 1.5 mm. The present invention discloses in claim 4 a pressure switch according to claim 1, wherein the area that said working shaft contacts said spherical surface is positioned inwardly from the end portion of said working shaft.

DETAILED DESCRIPTION OF PREFERRED EMBODIMENTS

Figure 1:
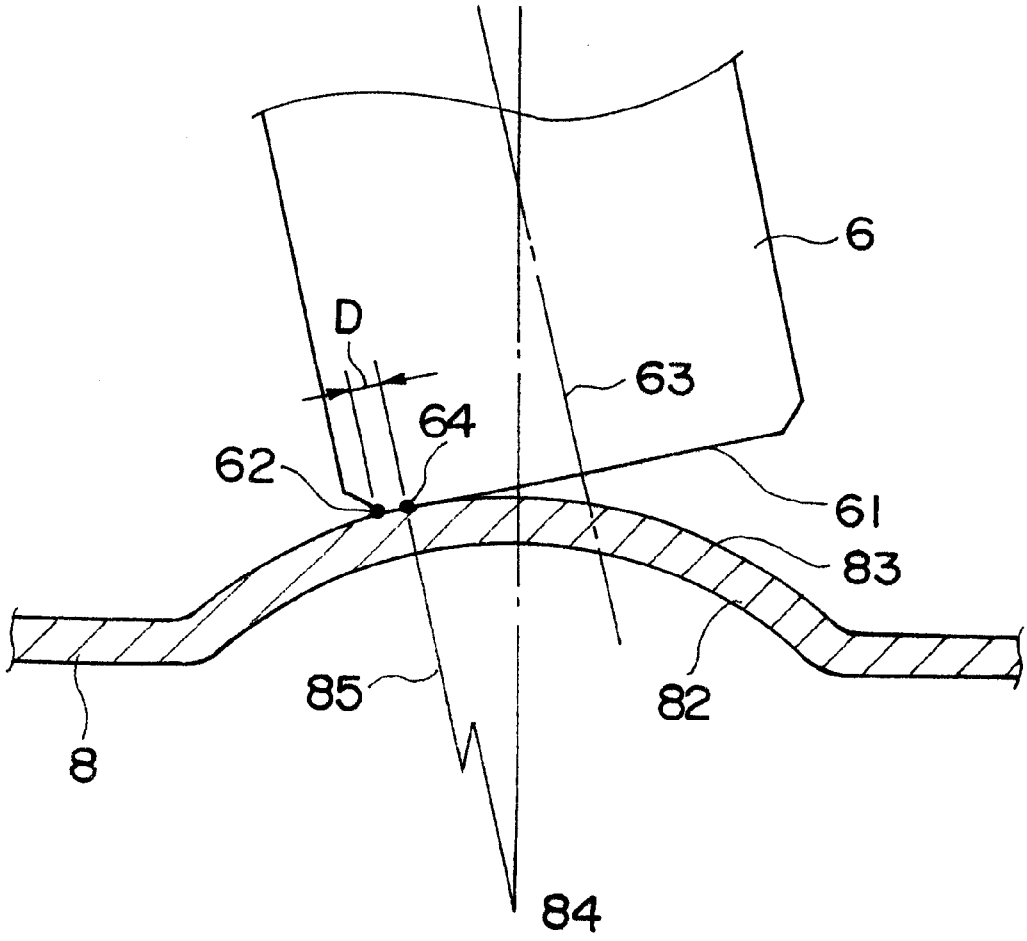
FIG. 1 is an enlarged cross-sectional view showing the structure of the main portion (the shapes of the working shaft and the switch lever) according to one embodiment of the pressure switch of the present invention.
Figure 2:
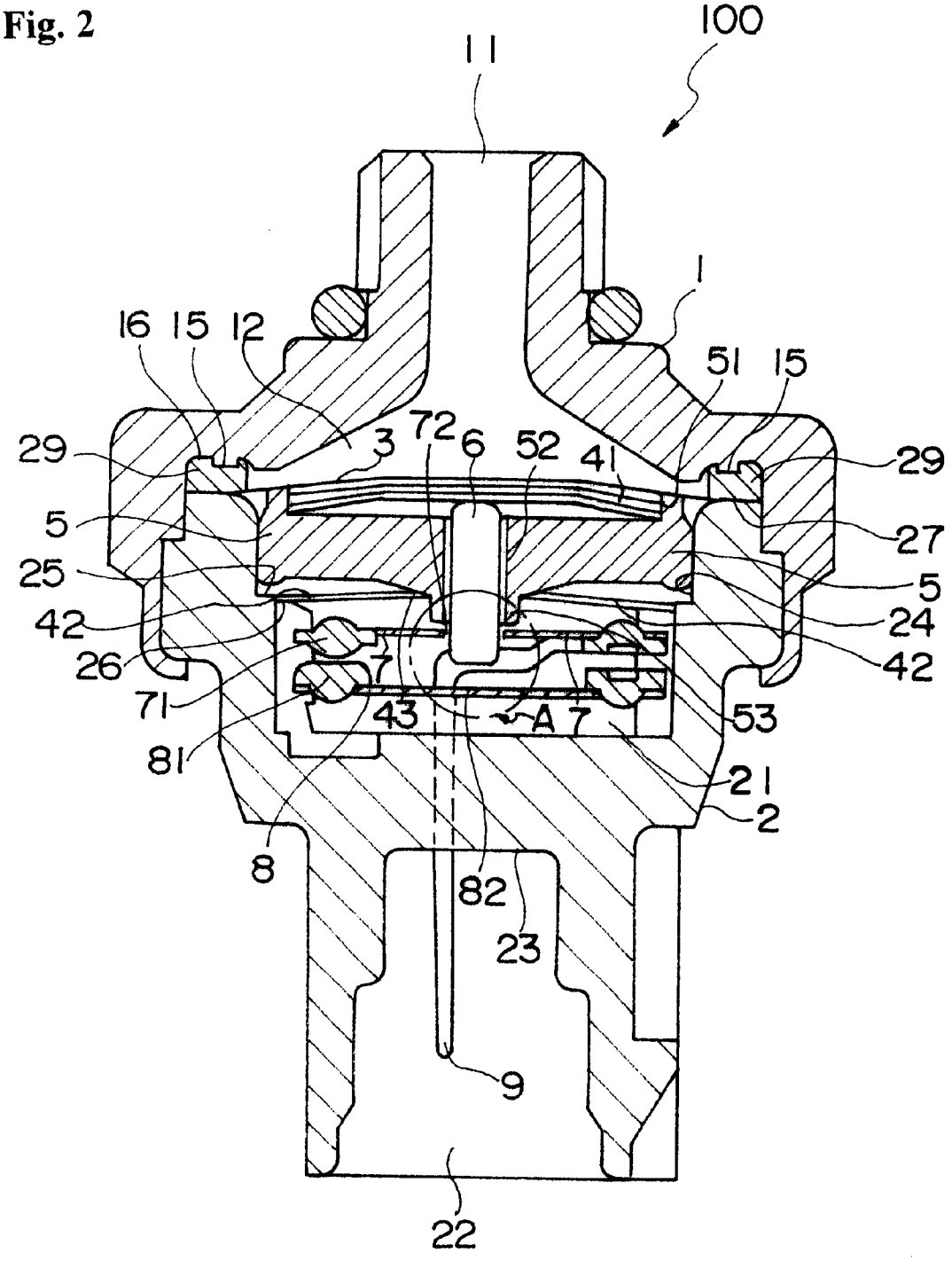
FIG. 2 is a vertical cross-sectional view explaining the structure of the pressure switch.
Figure 3:
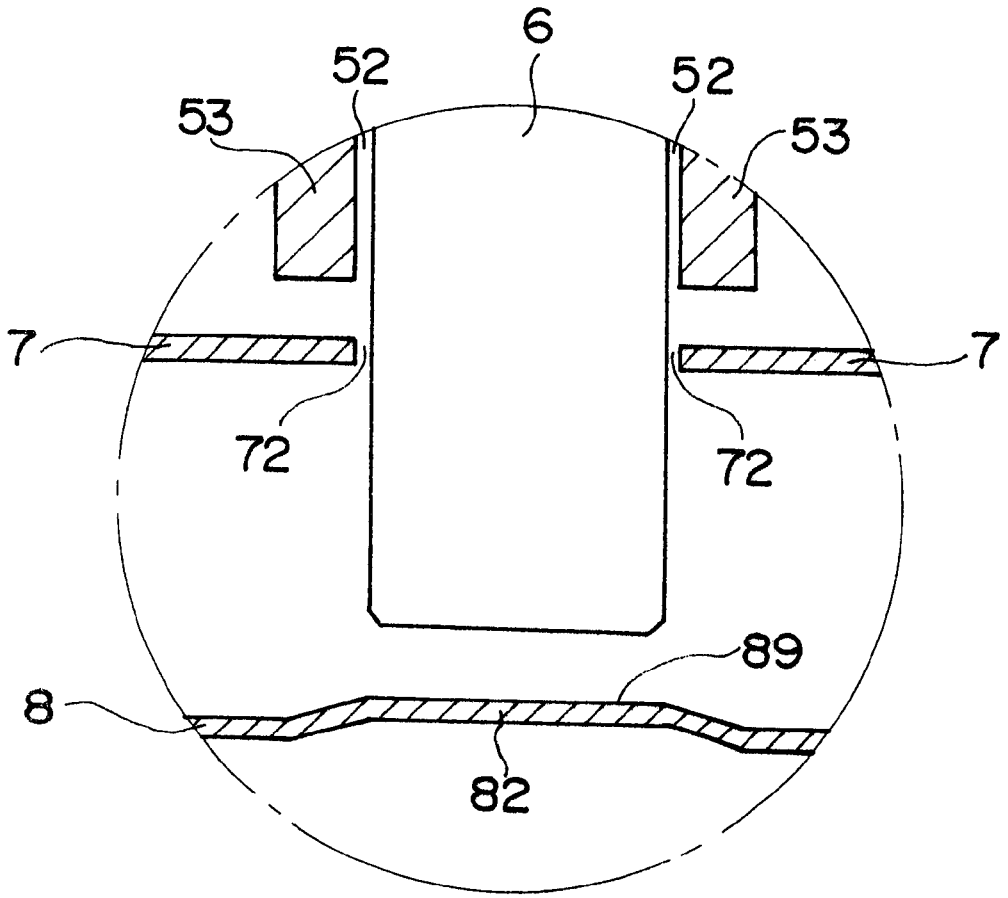
FIG. 3 is an enlarged cross-sectional view showing in part the structure of the working shaft and the contact portion of the switch lever in the pressure switch.
Figure 4:
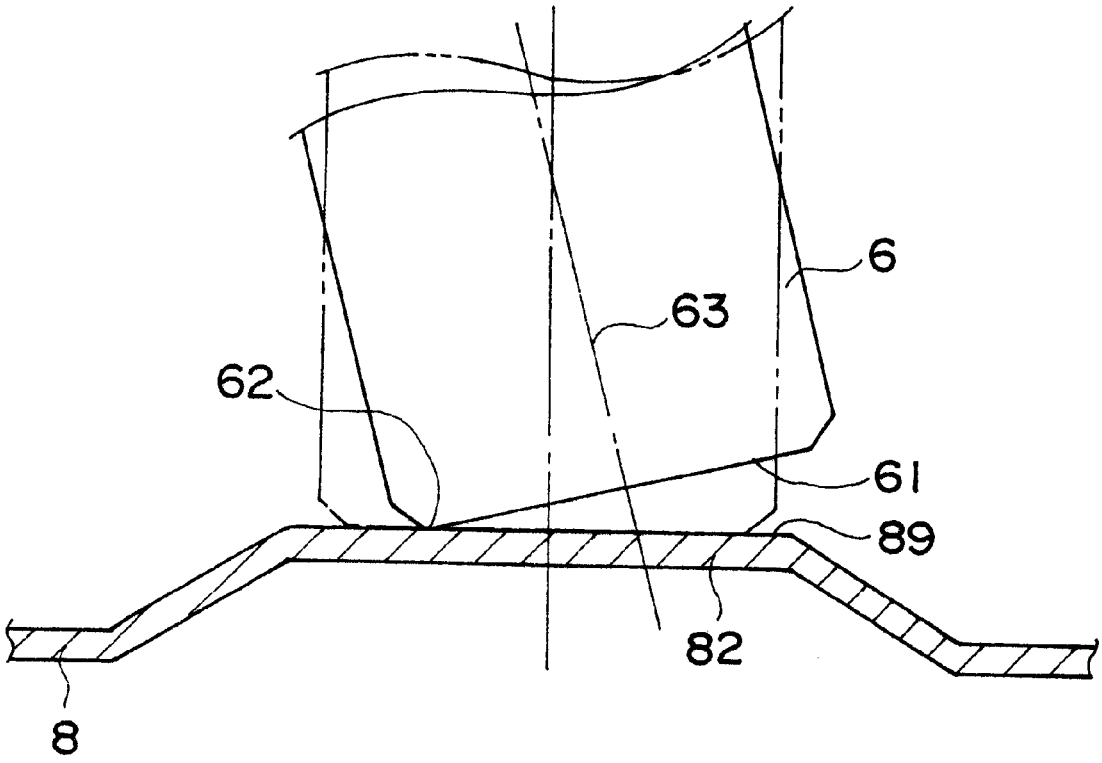
FIG. 4 is an enlarged cross-sectional view showing in part the contact status of the working shaft and the contact portion of the switch lever in the pressure switch of the prior art.

The preferred embodiment of a pressure switch according to the present invention is explained with reference to FIG. 1. FIG. 1 is a cross-sectional view showing the structure of the main portion of a pressure switch according to the present invention, wherein the drawing shows in enlarged view a working shaft 6 and a contact portion 82 equipped to a switch lever 8. Other structures of the present pressure switch not shown in the drawing are the same as those of FIG. 2.

As shown in FIG. 1, the pressure switch 100 of the present invention characterizes in that a contact portion 82 formed to a second switch lever 8 to which the working shaft 6 contacts is formed to have a shape different from that of the prior art pressure switch.

As shown in FIG. 1, the contact portion 82 to which the working shaft 6 contacts is formed to have a spherical surface. By forming the surface of the contact portion 82 to a spherical shape, an end surface 61 of the working shaft 6 will contact a spherical surface 83 of the contact portion 82 at a contact point 64, even when a center axis 63 of the working shaft 6 is tilted due to low assemble accuracy and the like.

In other words, the contact point 64 is positioned at a point in which a line 85, drawn from a center point 84 of the spherical surface parallel to the center axis 63 of the tilted working shaft 6, crosses the spherical surface 83. Since the contact point 64 is formed inwardly by distance D from a peripheral 62 of the end surface 61 of the working shaft 6, no stress will be concentrated around the peripheral 62 area. Therefore, even when the accuracy of assembly is relatively low, the peripheral 62 of the working shaft 6 will not be chipped.

Now, the result of the studies performed by the present inventors related to the chipping (breaking) of the working shaft 6 with regard to the radius of curvature of the spherical surface 83 of the contact portion 82 will be explained.

With reference to FIG. 1, a test is performed to study the status of the chip generated around the peripheral 62 of the end surface 61 of the working shaft 6, with regard to the relation between the radius of curvature of the spherical surface 83 of the contact portion 82 and the distance D between the contact point 64 and the peripheral 62 of the working shaft 6, on condition that the gap between the center axis 63 of the working shaft 6 and the center axis of the contact portion 82 is 0.1 mm.

As a result, when the radius of curvature is 2.0 mm or less, the peripheral 62 of the end surface 61 of the working shaft 6 will not be chipped. On the other hand, when the radius of curvature is less then 0.5 mm, it is discovered through experiment that the accuracy of processing the contact portion 82 through press-forming is lowered, and further, the contact portion is likely to be abraded through repeated contact with the shaft, since the area of the contact portion 82 is reduced.

That is, as the contact point between the working shaft 6 and the contact portion 82 moves inwardly from the peripheral 62 of the working shaft 6, in other words, as the contact point approaches the center axis 63 of the shaft 6, the possibility of pressure being concentrated to the peripheral 62 is reduced, and the possibility of a chip occurring to the shaft 6 is also reduced. However, since the peak area of the contact portion 82 is reduced, the area of contact between the shaft 6 and the contact portion 82 is also reduced, which may cause abrasion of the contact portion 82.

Based on the above studies, the inventors have found that the radius of curvature of the spherical surface of the contact portion 82 equipped to the switch lever 8 should preferably be in the range of 2.0 to 0.5 mm, and from the point of view of preventing abrasion and to improve workability, the radius of curvature should be in the range of 2.0 to 1.5 mm.

As explained above, according to the present invention, the peripheral 62 of the end surface of the working shaft 6 will not be chipped even when the working shaft is tilted due to low accuracy in assembling the pressure switch. Therefore, a highly reliable pressure switch which may be assembled easily is provided by the present invention.

In the above explanation, a two-action pressure switch is utilized. However, the present invention is not limited to such example, and it may be applied to other pressure switches such as a three-action pressure switch.

As explained, the present invention provides a pressure switch which is easy to assemble, and with high reliability, since the working shaft will not be chipped through use.

Moreover, the present invention provides a pressure switch capable of an accurate switching operation, having a design not greatly changed from that of the prior art pressure switch.

What is claimed is:

1. A pressure switch comprising:

a switch lever equipped with a contact; and a working shaft having an end surface and driven by fluid pressure to open or close said contact, said switch lever including a contact portion to which said end surface of said working shaft contacts at a contact point thereof; wherein said contact portion is formed to have a spherical surface so that said contact point is formed inside the periphery of the end surface of said working shaft, and spaced from a periphery of said end surface of said working shaft, and chipping of the periphery of said end surface is prevented upon contact when the working shaft is tilted, and said spherical surface has a radius of curvature in the range of 2.0 to 0.5 mm.

2. A pressure switch according to claim 1, wherein said spherical surface has a radius of curvature in the range of 2.0 to 1.5 mm.

3. A pressure switch according to claim 1, wherein the area that said working shaft contacts said spherical surface is positioned inwardly from the end portion of said working shaft.

* * * * *